US005605262A

United States Patent [19]

Bond

[11] Patent Number: 5,605,262

[45] Date of Patent: Feb. 25, 1997

[54] ADJUSTABLE WRIST BAND

[76] Inventor: James R. Bond, P.O. Box 280, Magnolia Springs, Ala. 36555

[21] Appl. No.: 457,122

[22] Filed: Jun. 1, 1995

[51] Int. Cl.[6] ..... A44C 5/12

[52] U.S. Cl. ..... 224/179; 224/176; 224/164; 224/170; 224/901.4

[58] Field of Search ..... 224/164, 167, 224/173, 176, 179, 901; 24/265 WS, 71 J, 265 B, 17 A, 17 B, 68 J, 265 H, 906, DIG. 22; 63/51, 6, 7, 8, 9, 11

[56] References Cited

U.S. PATENT DOCUMENTS

| | | | |
|---|---|---|---|
| 1,222,391 | 4/1917 | Grant . | |
| 1,498,126 | 6/1924 | Smith . | |
| 1,687,365 | 10/1928 | Dike . | |
| 1,818,637 | 8/1931 | Mathez . | |
| 2,466,742 | 4/1949 | Roehrl . | |
| 3,019,503 | 2/1962 | Placco et al. . | |
| 4,280,257 | 4/1981 | Kostanecki . | |
| 4,615,185 | 10/1986 | Bollinger | 24/17 A |
| 4,639,144 | 1/1987 | Chau . | |
| 4,941,236 | 4/1990 | Sherman et al. . | |

FOREIGN PATENT DOCUMENTS

| | | | |
|---|---|---|---|
| 216335 | 1/1957 | Australia | 224/4 |
| 74772 | 9/1917 | Switzerland | 224/4 |
| 847777 | 9/1960 | United Kingdom | 24/265 WS |

*Primary Examiner*—Henry J. Recla
*Assistant Examiner*—Kam Shah
*Attorney, Agent, or Firm*—Lane, Aitken & McCann

[57] ABSTRACT

A "C" shaped adjustable watch band having a pair of opposite orientated hooks on opposite arms of the band is provided. The arms of the band may be flexed toward each other and allowed to overlap. Hooks are positioned to allow the simultaneous engagement of apertures provided on the respective overlapping arms. Because the bands attempt to spring back to their original unflexed condition, the hooks are retained within the apertures and the band is securely held together.

10 Claims, 1 Drawing Sheet

ADJUSTABLE WRIST BAND

This invention relates generally to an adjustable watch or wrist band and further relates to an improved manner to attach opposite arms of a band together around the wrist of the wearer. The invention also relates to a novel manner of engagement of a watch face to the center region of a wrist band.

BACKGROUND OF THE INVENTION

There are numerous approaches to attach and secure a watch band, wrist band or bracelet to the wrist. One well known manner involves the use of straps made of leather or fabric and can be bent or folded without injury to the material. Such conventional strap bands typically incorporate a buckle with a keeper located at the end of a first band which engages one of a plurality of holes provided through a second band. These bands are not resilient and do not spring back to their original condition after force is applied. Bracelet type bands typically have a predetermined circumference and are typically secured with a clip or spring biased type of fastener. The circumference of bracelet type bands are commonly adjusted by removing a link from the band. Another common approach to securing a band to the wrist involves providing an elastic and resilient endless band which can expand to fit over the hand and then retract to snugly engage the wrist. Permutations of these approaches are rather extensive and include a variety of closure mechanisms. For example, magnetic closures, spring biased devices, resilient hook with looped fabric fasteners (sold under the registered trademark VELCRO) and snap fitting closures have all been employed to secure watch bands around the wrist.

The object of the invention is to provide a novel wrist band closure that can be easily manipulated by a wearer and secured around the wrist. A further object of the present invention is to provide an adjustable wrist band that can be economically manufactured. Yet a further object of the invention is to provide a wrist band in which a watch face can be easily assembled or removed.

SUMMARY OF THE INVENTION

The present invention provides an alternative manner to secure a watch band around the wrist which is both inexpensive to manufacture and easy to engage and disengage from the wrist. The watch band according to the invention is adjustable so that it can be worn by people having disparate wrist sizes. The manner the band engages a watch face allows the wearer to easily interchange the face. In an unflexed or relaxed condition the wrist band according to the invention is generally "C" shaped and has opposite arms which are both resilient and flexible thereby allowing the arms to be inwardly displaced to close the band. Because the arms are resilient, when the dispacing force is removed, the arms will spring back to their unflexed condition. A series of circular apertures is provided on each of the arms which serve as retaining means for a pair of hooks located on the ends of each respective arm. The hooks are oriented in opposite directions and apertures are designed so that both hooks can simultaneously engage corresponding apertures located on the opposite arms. Because the arms are resilient, after the hook engages an aperture there is potential energy stored in the band. This force urges the arms apart and thus serves to retain the hooks in place. Tension in the band thereby keeps the band in a closed and secure condition.

DETAILED DESCRIPTION

Figure 1:
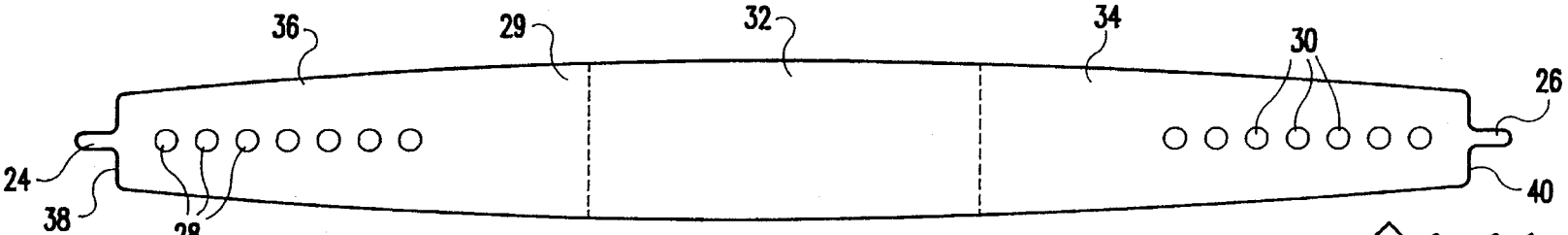
FIG. 1 is a top view in elevation of the band according to the invention at a preliminary stage of the manufacturing process.

Referring now to FIG. 1, to construct a band according to the invention, one begins with a flat elongate piece of 26 gauge stainless steel having a pair of tapering arms 34 and 36 which extend from a central region 32. Located at the end of each arm are extensions 24 and 26. Provided through each arm is a series of circular through holes identified by reference numerals 28 and 30. As FIG. 1 illustrates, each through hole has a corresponding through hole on the opposite arm formed equidistant from the respective terminal end of each arm. To form the wrist band according to the invention, arm 36 is bent inwardly around a suitable mandrel to thereby form a gradual curve from the proximal end 29 of the arm to the terminal end 38. Arm 34 is bent in the same fashion to result in a band having a horseshoe or "C" shape. The arms are bent beyond the material's elastic limit so that the band retains the curved shape. Hooks are formed on the ends of each arm by bending extensions 24 and 26 in a resupinate manner. While extension 24 is bent inwardly and back upon the first arm 36 the extension 26 is bent outwardly and then back upon the second arm 34. The hooks are also formed by bending the band material beyond its elastic limit.

In a preferred embodiment of the invention, the band is made from a single piece of 26 gauge stainless steel however other elastic materials such as metals with similar elastic and resilient properties, synthetic resins, wood or fiberglass would also be suitable for use. Even materials which are relatively rigid and have minimal resiliency characteristics could be satisfactory employed as a substitute material for the band if other means were provided to supply the requisite resiliency.

Figure 3:
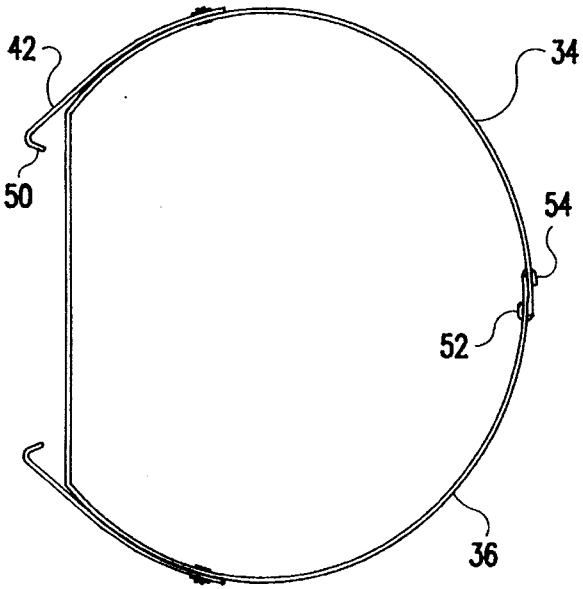
FIG. 3 is a side view in elevation of the band with the arms in a closed and secured position.
Figure 2:
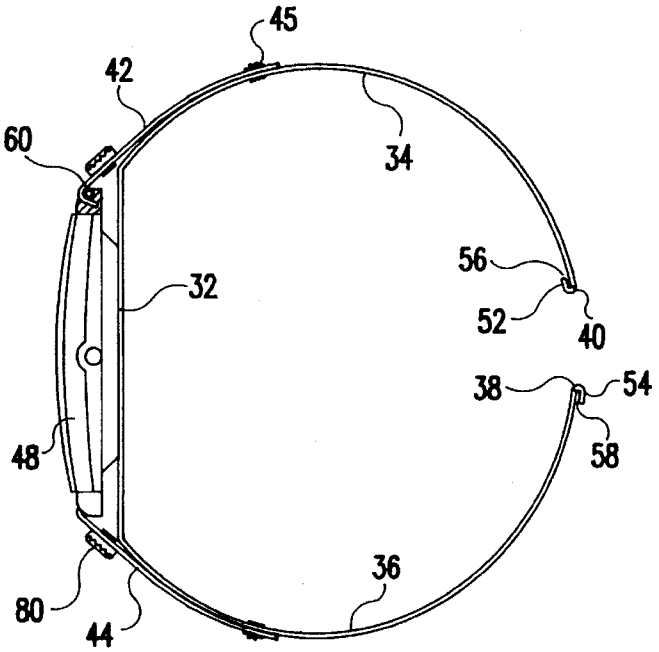
FIG. 2 is a side view in elevation of the band in engagement with a watch face with a fragmentary view of one end of the watch face showing the engagement of the clip to a pin on the watch face.

Referring now to FIG. 2, when the manufacturing steps as described above have been completed the wrist band according to the invention is "C" or horseshoe shaped when in a relaxed or unflexed position. Extending from the central region 32 are opposite arms 34 and 36 which project in an arcuate path and terminate at respective terminal ends 38 and 40. In the preferred embodiment of the invention, the central region 32 is flat and accepts a watch face 48. Secured on the outer surface of each arm of the wrist band are clips 42 and 44 which can engage the watch face. These clips are also made of 26 gage stainless steel and are secured to the respective arms by rivets. As shown in FIG. 2, clip 42 is secured by rivet 45 near the proximal end of the clip. As best seen in FIG. 3, the distal end 50 of the clip is bent back towards the central region 32 to form an acute angle with respect to the remainder or body of the clip. The bend in the clip, which defines the distal end, provides a location to receive a pin. As illustrated in FIG. 2 clip 42 is shown in engagement with pin 60. Like the arms, the clips are also both resilient and flexible and these characteristics enable the clips to secure the watch face in place over center region 32. The distal ends of the clips engage opposite pins provided on each side of the watch face to secure the face adjacent to the central region of the band. The clips thus hold the watch face in tension.

To insert or remove a watch face from the band, the distal end of the clips are pried away from the watch band to free the pins. This can be accomplished by inserting a tool such as a screwdriver into the gap between the distal end of the clip and the watch band and twisting the tool to force the parts away from each other. If it is desired to secure a watch face on the center region, a pin is positioned beneath the bent part of the clip when the distal end of the clip is flexed away from the band. When the force is released, the distal end of the clip is urged to return to its unflexed condition and the bent portion is allowed to engage the pin. In a preferred embodiment of the invention, an ornament 80 is secured to the outer surface of the clip.

Located on opposite terminal ends of the arms 34 and 36 are hooks 52 and 54. These hooks are integrally formed from the stainless steel band material by bending the extensions in the manner described above. As FIG. 2 demonstrates, hook 52 turns inwardly towards the central region of the wrist band while hook 54 turns outwardly. The hooks each define narrow gaps 56 and 58 between the distal end of each hook and each respective arm. These gaps, which are approximately 1/16 inch across, are slightly larger than the thickness of the arm members. Because the gap between the ends of the hook and the arm members is narrow, the unintentional engagement of extraneous materials by the hook is kept to a minimum. The hooks are also fabricated with blunt ends to reduce the chance that the hooks will inadvertently engage unintended matter. The rounded blunt ends on the hooks also facilitate the reception of the hooks into the round apertures provided through the band.

Each aperture on each arm has a corresponding aperture on the opposite arm which is the same size and located the same distance from the terminal end of the respective arm. This arrangement ensures that when a hook from one arm engages an aperture, the opposite hook has a corresponding aperture to engage in the opposite arm. The apertures are sized so that the blunt distal ends of the hooks can pass through the apertures unimpeded.

FIG. 3 illustrates the band in a closed and secure position without a watch face in engagement by the clips. In the secured position outer arm 34 overlaps inner arm 36 causing the outer arm's inner surface to contact the outer surface of the inner arm 36. Hook 54 passes through an aperture in arm 34 and, as the force is released, may engage the aperture's edge which is closest to the terminal end of the arm. Hook 52 passes though an aperture in inner arm 36 and engages the inner arm in an analogous fashion.

The arms 34 and 36 are constructed of a resilient material so that the application of force on the outer planar surface of the arm members (the sides of the arms) will displace the arm members to result in the configuration depicted in FIG. 3. When the deforming force is removed, the arms will attempt to recover to their original configuration so long as the force applied is less than the material's elastic limit. When the hooks are engaged in the apertures located in the opposite arms, the arms are prevented from returning to their relaxed position and thus, the wrist band remains in tension.

Figure 4:
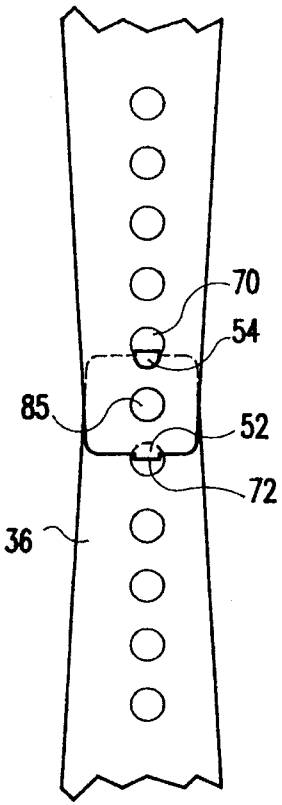
FIG. 4 is an partial end view in elevation of the opposite arms of the band shown in engagement with one another.

To secure a band according to the invention around the wrist, force is simultaneously applied to the outer surface of the first and second arm members by the thumb and forefinger to cause the arms to be inwardly displaced thereby reducing the distance between the terminal ends of the arm members. Continued application of force to the outer surface or sides of the arms causes the first arm member to overlap the second arm member thereby forming a closed loop. Reduction of the applied force allows the arms to begin to return towards their original relaxed position. Referring now to FIG. 4, as the force is reduced and the opposite arms move past each other to return to their relaxed condition, the resupinate end portion of outwardly turning hook 54 can extend through an aperture 70 formed through arm 34. As the band continues to return to the relaxed position, the hook 54 engages the periphery of the aperture 70 and thereby engages the opposite arm 34. Because the apertures on the inner arm are positioned at precise distances in relation to each other and the hooks, the inwardly turning hook 52 on outer arm 34 can simultaneously extend through a corresponding aperture 72 on arm 36 and engage the inner arm 36. The force which urges the arms to return to their original unflexed condition keeps the band in tension and thereby keeps the hooks securely engaged in the apertures. The novel manner of engagement also has the advantage of keeping the ends of the bands in close proximity to each other and therefore dispenses with the need to provide a separate sleeve structure to retain the outer band. By selecting the aperture in which to secure the hooks, the band can be adjusted to snugly engage the wrist or be secured at a diameter larger than the wrist so the band can be worn loosely like a bracelet.

To remove the band, force is again simultaneously applied to the outside surface of the arm members on the sides of the arms. As force is applied, the inner and outer bands are caused to move past each other in opposite direction reducing the diameter of the band. When the end of the outwardly oriented hook 54 passes the edge of the aperture 70 in which it is engaged, a slight force is then applied by the thumb to the inner arm 36 near the distal end of the arm in a direction downward towards the central region. This force must be sufficiently strong enough to enable the hook 54 to clear aperture 70 and simultaneously disengages hook 52. When the hooks clear the respective ends of the arms, the downward force component may be released. Release of the force on the sides of the arms allows the arms to return to their original relaxed position as depicted in FIG. 2.

The foregoing is considered as illustrative only of the principles of the invention. Since numerous modifications and changes will be apparent to those skilled in the art, the invention is not limited to the exact construction and operation shown and described herein. Thus the scope of the invention is defined only by the terms of the following claims and art recognized equivalents thereof.

I claim:

1. A wrist band comprising a center region, a first arm member and a second arm member, said first arm member and second arm member adapted to be connected to said center region in a non-pivoted member and extend from said center region to form a "C" shape when said wrist band is in a relaxed condition, resilient means to enable said first and said second arm members to be resiliently flexed towards each other and allow an outside surface of said first arm to contact an inner surface of said second arm causing said first arm and said second arm to overlap one another, said first arm member and said second arm member each having a plurality of hook retaining means, said hook retaining means formed at positions equidistant from terminal ends of said first arm member and said second arm member, a first hook formed on said terminal end of said first arm member turning towards said central region, a second hook formed on said terminal end of said second arm member extending away from said central region, said first and second hooks, said hook retaining means and said resilient means further comprising fastening means to secure said first and second arm members together wherein said first and second hooks are retained in said hook retaining means located on opposite arms by force applied by said resilient means urging said arms to move away from each other in a tangential direction, thereby causing said first and second hooks to engage said hook retaining means and said engagement causing both said arms to independently prevent movement away from each other thereby retaining said wrist band in tension when in a closed position and said first and second arms coupled together.

2. The wrist band as recited in claim 1 wherein said hook retaining means are apertures through said arms.

3. The wrist band as recited in claim 2 wherein each said apertures are circular.

4. The wrist band as recited in claim 1 further comprising a watch face and watch face retaining means to secure said watch face to said wrist band.

5. The wrist band as recited in claim 4 wherein said watch face has a pair of opposite pins and said watch face retaining means further comprise a pair of clips, each of said clips comprising a resilient body and a distal bent end, said bent end forming an acute angle with said resilient body and said bent end being directed towards the wristband, wherein said bent ends on said clips engage said opposite pins on said watch face.

6. The wrist band as recited in claim 1, wherein said arms comprise a flexible and resilient material.

7. The wrist band as recited in claim 6, wherein said resilient means comprise said arms.

8. The wrist band as recited in claim 1 wherein said first and second hooks are integrally formed with said arms by bending extensions which extend from said arms back upon the arms.

9. The wrist band as disclosed in claim 1 wherein said central region, and said first and second arm members comprise a single integral part.

10. A wrist band comprising a single flexible and resilient band formed in the shape of a "C" when in a relaxed position, said wrist band having a first and a second arm, said first arm having a hook, said second arm having a plurality of hook retaining means, wherein said hook is retained in one of said plurality of hook retaining means by a force created by flexing said arms toward each other by application of a force to said arms thereby storing energy in the band and putting the band in compression wherein the arms are tangentially urged away from one another and when said band is in said compression said hook can be positioned to engage said retaining means and thereby retain said wrist band in a closed and compressed condition.

* * * * *